United States Patent [19]

Chiang

[11] Patent Number: 4,846,474

[45] Date of Patent: Jul. 11, 1989

[54] SWIVEL GLIDE BAR RAIL TABLE FOR A RACQUET STRINGING MACHINE

[76] Inventor: Chinn-Chann Chiang, 8116 Pilgrims Pl., Austin, Tex. 78759

[21] Appl. No.: 85,767

[22] Filed: Aug. 17, 1987

[51] Int. Cl.[4] ..... A63B 51/14

[52] U.S. Cl. ..... 273/73 A; 269/71

[58] Field of Search ..... 273/73 R, 73 A, 73 B; 269/289, 71, 73

[56] References Cited

U.S. PATENT DOCUMENTS

| | | | |
|---|---|---|---|
| 2,100,948 | 11/1937 | Doll | 273/73 A |
| 2,146,853 | 2/1939 | Ryckman | 273/73 A |
| 3,511,502 | 2/1968 | Spenlé | 273/73 A |
| 4,156,525 | 5/1979 | Parnell | 273/73 A |
| 4,376,535 | 3/1983 | Muselet et al. | 273/73 A |

*Primary Examiner*—Richard C. Pinkham
*Assistant Examiner*—William E. Stoll
*Attorney, Agent, or Firm*—Antonelli, Terry & Wands

[57] ABSTRACT

A swivel glide bar rail table for stringing racquets in which glide bars and clamps are mounted on a rotatable table to permit a change in clamp orientation without the need for removing the clamps and glide bars. Glide bar rails are mounted on a disk which pivots and can be secured in a variety of positions depending on the desired string orientation. The rotatable table is retained in stringing position by screws with stepped heads which are positioned beneath a fixing plate.

4 Claims, 3 Drawing Sheets

SWIVEL GLIDE BAR RAIL TABLE FOR A RACQUET STRINGING MACHINE

BACKGROUND OF THE INVENTION

The present invention relates generally to a glide bar rail table for a racquet stringing machine and, more particularly, to an improvement in a swivel glide bar rail table which greatly improves the convenience in stringing racquets, especially racquets with unconventional string patterns.

Most present day racquet stringing machines use rectangular or square glide bar rail tables so that two rails are parallel to the main strings running in the vertical direction of the racquet and two other rails are perpendicular to the main strings and parallel to the cross strings. Typically, in stringing the main strings with these types of devices, glide bars are mounted, along with the clamps, on the rails parallel to the main strings; then, after finishing the main strings, in stringing the cross strings, the glide bars are mounted on the rails parallel to the cross strings. It is usual to start with the main strings.

However, with the foregoing arrangement, the stringer has to first remove the clamps after finishing the main strings and then remove the glide bars. The glide bars then have to be remounted on the rails parallel to the cross strings followed by mounting of the clamps. I have found that these remounting steps are very inconvenient and unnecessarily time-consuming.

Moreover, the modern advances in racquet design have brought about string patterns other than the perpendicular main string-cross string pattern. For instance, some racquets have three-directional string patterns which cannot be strung by conventional stringing machines of the aforementioned type without the use of special clamps.

SUMMARY OF MY INVENTION

It is a main object of my present invention to overcome the shortcomings and inconveniences found in conventional stringing machines.

More specifically, it is an object of my invention to minimize the inconvenience caused by stringing in two different directions while, at the same time, increasing the range of usefulness of stringing machines for unconventional patterns.

I have achieved the foregoing objects by providing a swivel glide bar rail table in which only two parallel glide bar rails are used and are fixed on a swivel table. Thus, with the more conventional perpendicular main string-cross string pattern, the stringer starts by fixing the rail table in such a way that the rails are parallel to the main strings. After finishing the mains, the stringer simply turns the rail table by 90 degrees, without removing the stringing clamps and the glide bars, so that the rails are parallel to the crosses. If the stringer is required to string an unconventional pattern, he or she turns the rail table to the angle which will cause the rails to be parallel to the direction of the strings to be strung. Again, this is done quickly and without the necessity for removing the clamps and the glide bars.

BRIEF DESCRIPTION OF THE DRAWINGS

These and further features, objects and advantages of my invention will become more apparent from the following detailed description of a currently preferred embodiment when taken together with the accompanying drawings which show, for illustrative purposes, that embodiment and wherein.

DETAILED DESCRIPTION OF A PREFERRED EMBODIMENT

Figure 1:
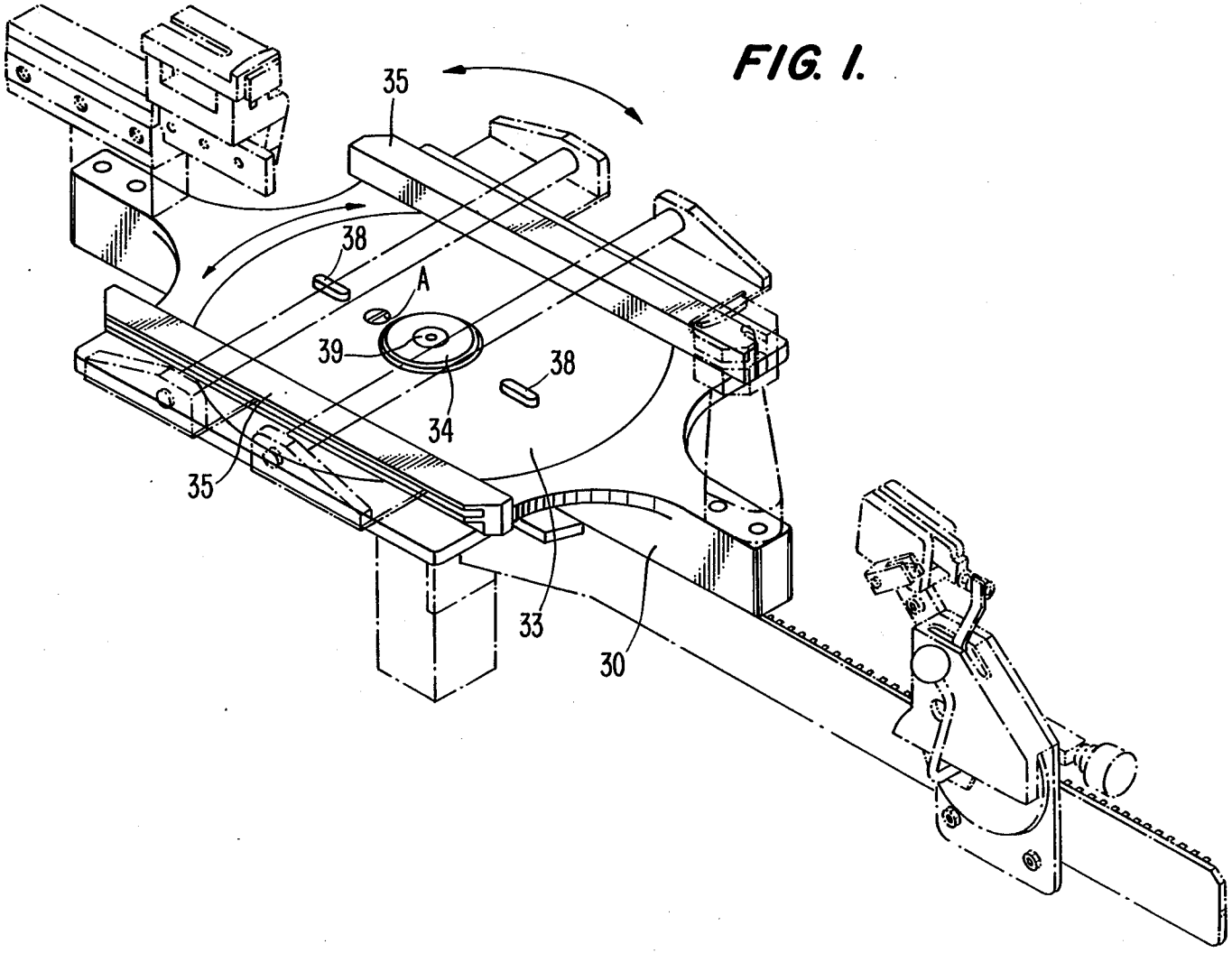
FIG. 1 is a perspective view of the overall table assembly incorporating my invention, but with conventional parts shown in phantom lines.
Figure 2:
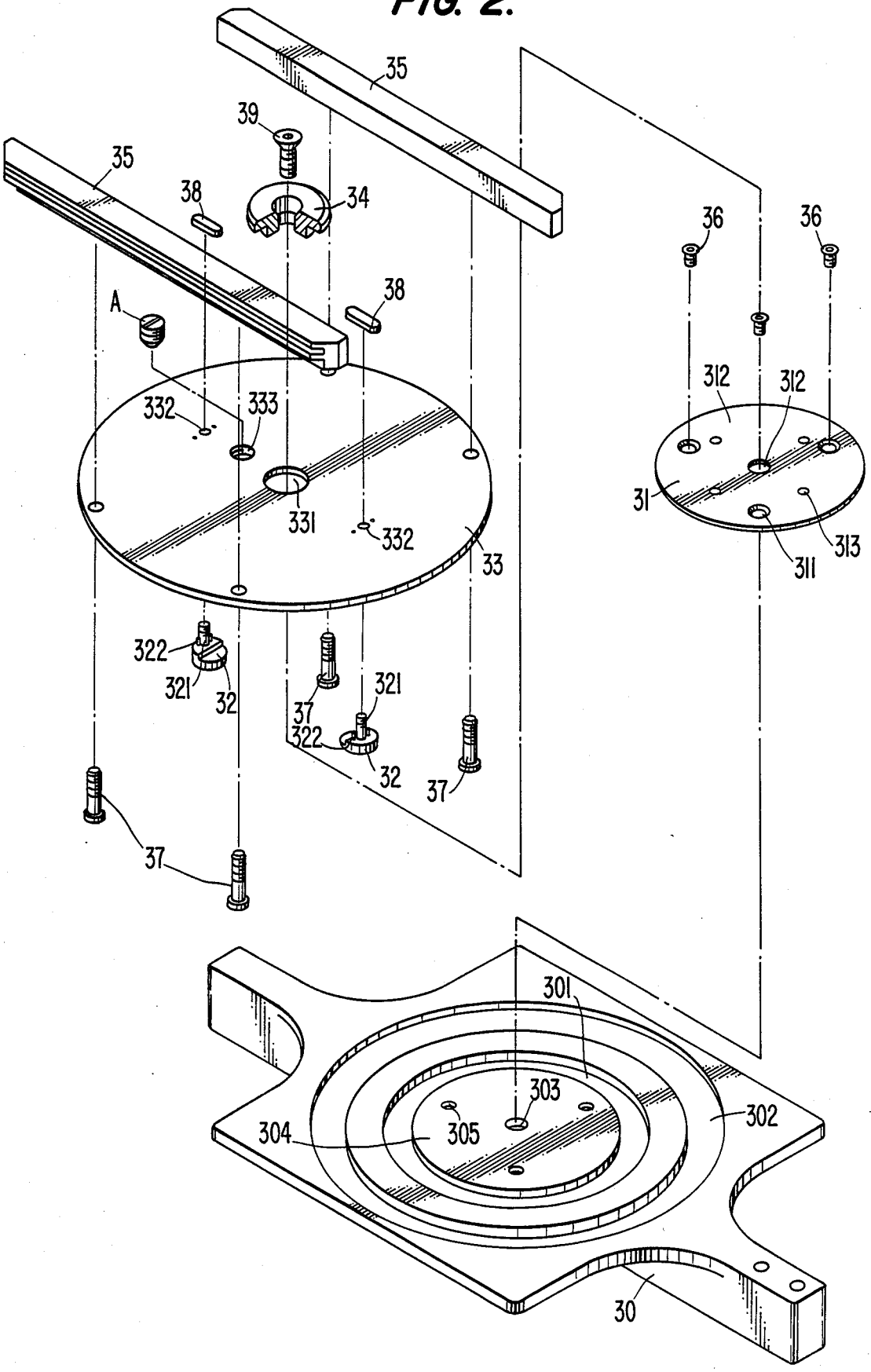
FIG. 2 is a exploded perspective view of my swivel rail table.

Referring now to the drawings and, in particular, to the perspective assembly drawing in FIG. 1, there is shown a tray table 30 mounted on the stringing machine bed. The tray table 30 has a large disk 33 which can be rotated to a fixed position around a centrally disposed screw 39 as shown in greater detail in FIGS. 4 and 5. A T-shaped ring 34, shown partially broken away in FIG. 2, is disposed on the disk 33 through which the screw 39 extends. Two glide bar rails 35 are mounted on the tray table 30 near the outer peripery of the disk 33. Nuts 38 are on top of the disk 33 for a reason to be more fully described below.

Turning now to FIG. 2, the tray table 30 is provided with two concentric circular channels, inner channel 301 and outer channel 302. A central platform 304 is bounded by the inner channel 301 and has a hole 303 at the center of the circular platform 304 for accommodating the screw 39. Three equidistantly spaced holes 305 with screw threads are spaced around the platform 304.

Figure 5:
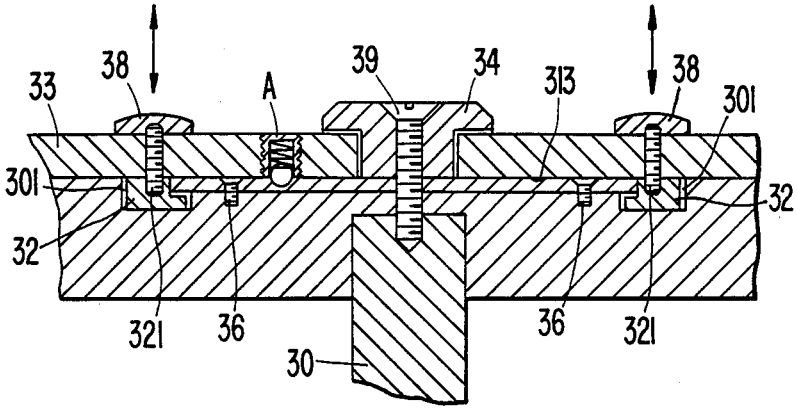
FIG. 5 is an isolated cross-sectional view in greater scale of the oval portion shown in phantom line in FIG. 4.

A small disk 31 has a central aperture 312 and a diameter somewhat larger than the diameter of the central circular platform 304 on the tray table 30 as shown in FIG. 5. The disk 31 has three equidistantly spaced holes 311 which overlie the holes 305. Screws 36 are passed through the holes 311 and into the mating threads in the holes 305 during assembly of the device. Four detents 313 are spaced equidistantly around the surface of the disk 31.

Figure 4:
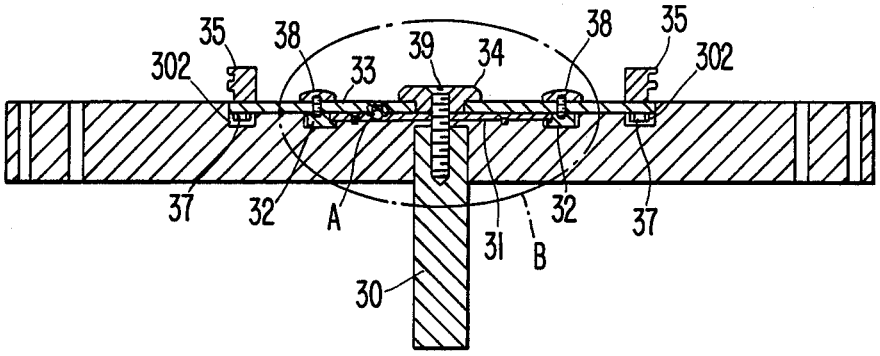
FIG. 4 is a cross-sectional view of my swivel table shown in FIG. 2.

A large disk 33 is placed over the small disk 31 and covers the remaining exposed portion of the inner channel 301 not covered by the small disk 31 and outer channel 302, on the tray table 30. The disk 33 has two threaded apertures 332 which respectively align with the inner channel 301 on the table 30. Ladder head screws 32 having threaded shanks 321 and stepped ladder heads 322 fitting with the inner channel 301 pass through the threaded holes 332 in the disk 33. Holes whose radius from the central hole 31 corresponds to the radius of the outer channel 302 are also provided at the periphery of the disk 33 to permit passage of threaded members 37 for securing the glide bar rails 35 in a fixed parallel position on the disk 33. The heads of the members 37 are accommodated in the outer channel 302 as seen in FIG. 4. The hole 331 at the center of the disk accommodates the vertical position of the T-shaped ring 34 and the pivot screw 39.

Figure 3:
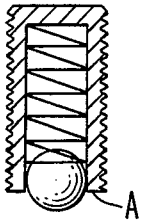
FIG. 3 is a cross-sectional view of a spring screw shown in FIG. 2.

The previously described nuts 38 mate with the threaded shanks 321 of the ladder head screws 32 secured in the channel 301 by the edge of the small disk 31 cooperating with the stepped portion of the head 322 (as shown in FIG. 5) passing through the disk 33. On a radius intermediate the central hole 331 and the holes 332 on the disk 33 another threaded hole 303 is provided to accommodate the threaded spring screw A shown in FIG. 3. The screw A is hollow and has a ball urged outwardly by a spring or the like. Again, as shown in more detail in the enlarged cross-sectional view in FIG. 5, the ball of the screw A is biased outwardly to engage in one of the detents 313 on the small disk 31 to hold the assembly in a desired position.

It will now be readily appreciated that in assembling the system, the ladder head screws 32 are placed in the inner channel 301. The small disk 31 is then put over the central platform 304 and is fixed thereon by screws 36 through holes 311, 305. The position of the ladder head screws is then adjusted so that the same align with the holes 32 on the large disk 33 on which the glide bar rails 35 have been mounted and which is then placed over the small disk 31 so that the nuts 38 can be tightened on the threaded shanks 321 of the ladder head screws 32. Thereafter, the T-shaped ring 34 is placed into the center hole 331 of the large disk 33, and the pivot screw 39 is passed through the ring 34 to thread in the hole 303.

In use, the glide bars of the type shown in phantom line in FIG. 1 with stringing clamps thereon are mounted on the rails 35. In order to string the mains, the large disk 33 is turned so that the rails are parallel to the direction in which the mains are to be strung. At this position, the ball in the screw A (FIG. 3) should be biased into form-locking engagement in one of the detents 313 on the small disk 31. The nuts 38 are then tightened to fix the position of the large disk 33 on the tray table 30. After finishing the mains, the nuts 38 are loosened and the disk 33 is turned to position the rails parallel to the direction of the crosses or to another direction of strings in an unconventional pattern, after which the nuts 38 are tightened to permit the string operation to begin.

While I have shown one embodiment in accordance with my present invention, it is to be clearly understood that the same is susceptible of numerous changes and modifications without departing from the scope of my invention. I, therefore, do not intend to be limited to the details shown and described herein, but intend to cover all such changes and modifications within the scope of the appended claims.

I claim:

1. A swivel glide bar rail table, for stringing racquets, comprising a tray table, rail means for mounting clamps and glide bars used in the stringing operation, and means operatively connected with said tray table and upon which said rail means are fixedly positioned for rotation of said rail means to two or more selected positions with respect to said tray table wherein said rotation means includes a disk upon which said rail means are positioned, said rotation means includes a second disk of smaller diameter than the first-mentioned disk wherein said second disk is fixed to the tray table intermediate said first disk and said tray table, and said tray table is provided with an annular groove which is partially covered by said second disk, a means provided in said groove for locking said first disk at selected stringing positions.

2. A swivel glide bar rail table according to claim 1, wherein said locking means comprises at least one threaded member having a stepped ladder head in said groove and under a peripheral portion of said second disk and nut means associated with the threaded member.

3. A swivel glide bar rail table, for stringing racquets, comprising a tray table, rail means for mounting clamps and glide bars used in the stringing operation, and means operatively connected with said tray table and upon which said rail means are fixedly positioned for rotation of said rail means to two or more selected positions with respect to said tray table further comprising means for temporarily holding said rotation means in a selected position, wherein said rotation means includes a disk upon which said rail means are positioned, said rotation means includes a second disk of smaller diameter than the first-mentioned disk where said second disk is fixed to the tray table intermediate said first disk and said tray table, said temporary holding means comprises detent means at various positions in one of said first disk, second disk and tray table, male means cooperating with said detent means, and biasing means to urge said male means into cooperation with said detent means, and said tray table is provided with an annular groove which is partially covered by said second disk, a means provided in said groove for locking said first disk at selected stringing positions.

4. A swivel glide bar rail table according to claim 3, wherein said locking means comprises at least one threaded member having a stepped ladder head in said groove and under a peripheral portion of said second disk and nut means associated with the threaded member.

* * * * *